United States Patent [19]

Rogerson et al.

[11] 4,229,387

[45] Oct. 21, 1980

[54] CARBURETOR FUEL FLOW CONTROL VALVE ASSEMBLY

[75] Inventors: Jerry B. Rogerson, Dearborn, Mich.; Robert F. Connin, Toledo, Ohio; Harold E. Benedix, Jr., Troy, Mich.

[73] Assignee: Ford Motor Company, Dearborn, Mich.

[21] Appl. No.: 973,049

[22] Filed: Dec. 26, 1978

[51] Int. Cl.[3] ..... F02M 7/20

[52] U.S. Cl. ..... 261/66; 123/438; 251/133; 261/DIG. 74

[58] Field of Search ..... 261/DIG. 74, 69 A, 51, 261/66; 123/119EC; 251/133

[56] References Cited

U.S. PATENT DOCUMENTS

| | | | |
|---|---|---|---|
| 2,507,988 | 5/1950 | MacMillan | 123/119 EC |
| 2,705,123 | 3/1955 | Hieger | 261/69 A |
| 2,831,471 | 4/1958 | Schoonover | 261/DIG. 74 |
| 3,235,237 | 2/1966 | Goetz et al. | 261/69 A |
| 3,841,283 | 10/1974 | Wood | 261/DIG. 74 |
| 3,899,552 | 8/1975 | Bauer | 261/DIG. 74 |
| 3,906,910 | 9/1975 | Szlaga, Jr. | 123/119 EC |
| 3,907,941 | 9/1975 | Herbert et al. | 261/51 |
| 3,976,279 | 8/1976 | Walker | 251/267 |
| 3,994,268 | 11/1976 | Okunishi et al. | 123/32 ST |
| 4,052,968 | 10/1977 | Hattori et al. | 123/119 EC |
| 4,065,920 | 1/1978 | Minami et al. | 123/119 EC |
| 4,135,482 | 1/1979 | Bier et al. | 261/69 R |
| 4,136,645 | 1/1979 | Ito et al. | 261/DIG. 74 |

FOREIGN PATENT DOCUMENTS

| | | | |
|---|---|---|---|
| 2458666 | 6/1976 | Fed. Rep. of Germany | 123/119 EC |
| 2529663 | 1/1977 | Fed. Rep. of Germany | 123/119 EC |
| 1445849 | 8/1976 | United Kingdom | 123/119 EC |

*Primary Examiner*—Tim R. Miles
*Attorney, Agent, or Firm*—Robert E. McCollum; Clifford L. Sadler

[57] ABSTRACT

An electro-mechanical cartridge type fuel flow control valve assembly that can be substituted as a whole for the conventional power valve unit of a carburetor to convert the carburetor to one of the feedback type. The cartridge includes a stepper motor threadedly engaging a needle like power valve for vertically moving the power valve to vary fuel flow upon energization of any of four terminals formed as a quick disconnect coupling as part of the cartridge.

3 Claims, 2 Drawing Figures

CARBURETOR FUEL FLOW CONTROL VALVE ASSEMBLY

Figure 1:
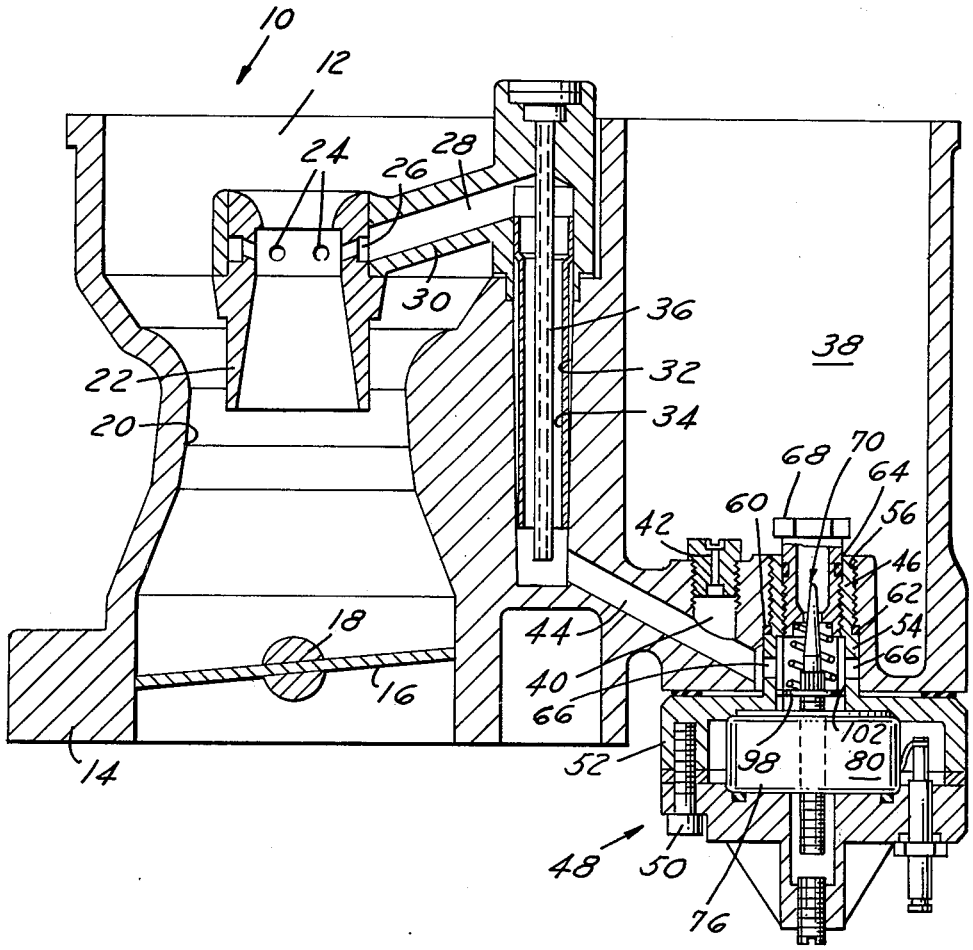

This invention relates in general to an automotive type carburetor for an internal combustion engine, and more particularly to a cartridge type fuel flow control assembly that can be quickly and easily assembled to and disassembled from the carburetor.

Feedback type carburetors are known in which signals from the exhaust system of an internal combustion engine as well as from other portions of the engine are received by a computer or electronic control device that indicate continuously the current particular air/fuel ratio of the mixture charge flowing to the engine. If this air/fuel ratio is other than as scheduled for that particular moment, a signal generally is supplied to the carburetor air flow or fuel circuit or both to reschedule the volume of air or fuel to return the air/fuel ratio to the desired value. For example, U.S. Pat. No. 3,994,268, Okunishi et al., shows in FIG. 3 solenoid controlled air bleed for controlling the air/fuel ratio of the mixture. Okunishi also states that fuel flow through passage 24 can be controlled directly, if desired. U.S. Pat. No. 4,065,920, Minami et al., also shows an electronic control of an auxiliary air passage to control the air/fuel ratio of the mixture flow through the carburetor. Also see U.S. Pat. No. 2,831,471, Schoonover, which describes an on-off type solenoid controller power valve.

This invention is related to a compact electromechanical cartridge type fuel flow control valve assembly that can be easily attached or disconnected from the float bowl of a carburetor as a replacement for the conventional power valve assembly to convert the carburetor to one of the feedback type. More particularly, the invention relates to a unitary cartridge that includes a power valve fuel well that projects up into the carburetor float bowl and contains a needle type power valve driven vertically by a stepper motor that can move the valve in discrete steps upon receiving impulses from an electronic control unit to a male-female type quick disconnect electrical connection formed as part of the cartridge assembly.

It is a primary object of the invention to provide an electro-mechanical cartridge type fuel flow control assembly that is complete in itself and can be readily substituted for the conventional power valve assembly unit of a carburetor to convert the carburetor to one of the feedback type for more accurate control of the flow of fuel through the carburetor.

It is another object of the invention to provide a cartridge type fuel flow control valve assembly of the type described above that includes a needle type power valve that is variably moved in discrete steps by a stepper motor threadedly engaging the power valve and energized selectively in either direction in separate phases through a quick disconnect type electrical connection formed as part of the assembly and incorporated in the cartridge.

While the invention is directed primarily for use as a replacement for a fuel metering type power valve, it will be clear that it would have use equally as well to control the movement of a main fuel metering system rod.

Figure 2:
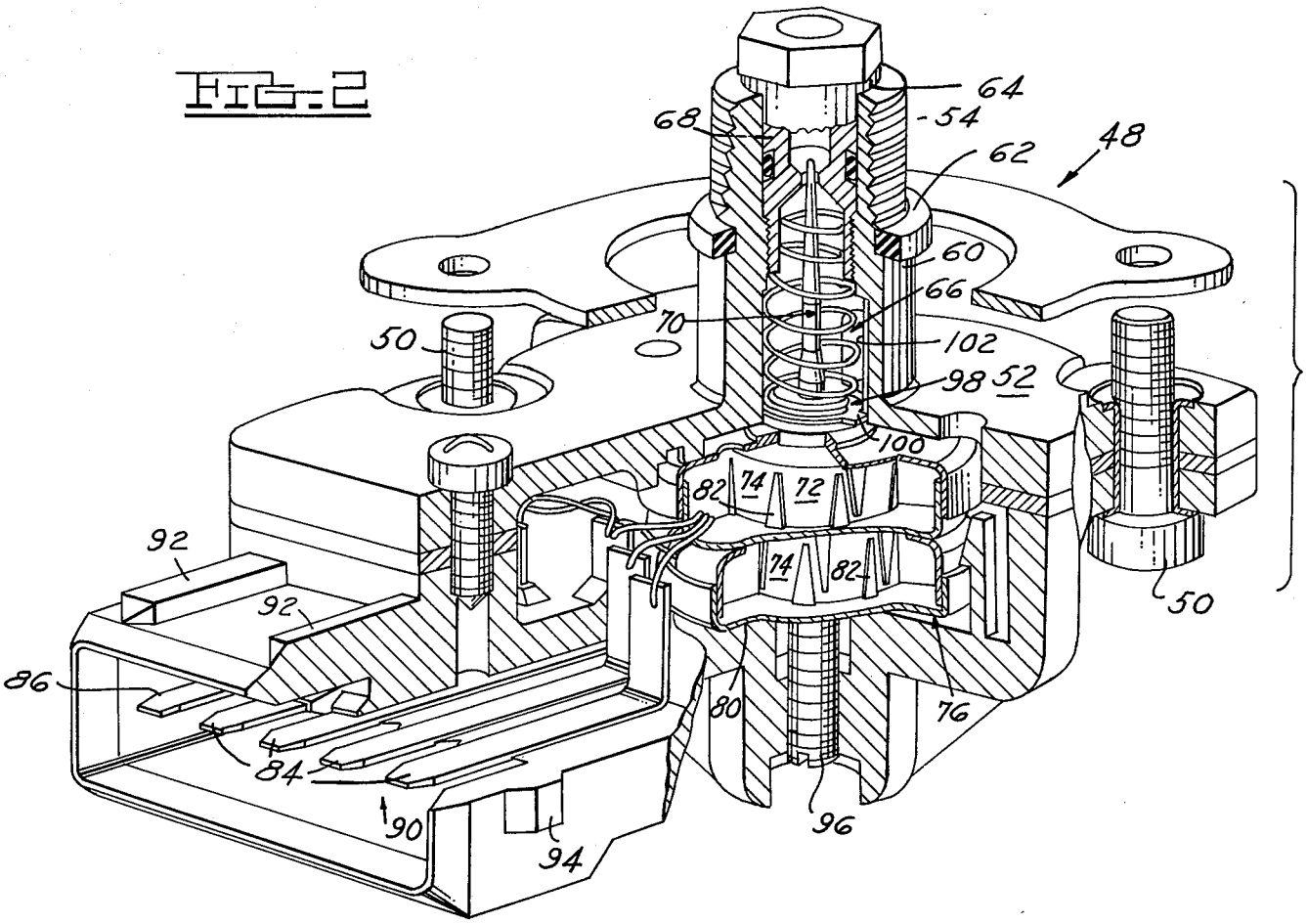

Other objects, features and advantages of the invention will become more apparent upon reference to the succeeding detailed description thereof, and to the drawings illustrating the preferred embodiment thereof; wherein, FIG. 1 is a cross-sectional view of the main body portion of a carburetor embodying the invention; and, FIG. 2 is an enlarged perspective view of the cartridge type power valve assembly illustrated in FIG. 1.

FIG. 1 shows the main body casting 1 of a known type of single barrel, downdraft carburetor 10. It has the usual main induction passage 12 that is open at its upper end to the air horn section (not shown) of the carburetor, and is flanged at its lowr end 14 for connection to the intake manifold of an internal combustion engine, in the usual manner. A rotatable throttle valve 16, fixed on a shaft 18 rotatably mounted in the side walls of the carburetor, is movable from the closed position shown to a nearly vertical wide-open position to control the flow through induction passage 12.

The passage 12 is formed with the conventional fixed area venturi 20 within which is a boost venturi 22 having a plurality of main fuel inlet holes 24. The latter communicate with an annular fuel chamber 26 connected to a passage 28 through a strut 30 that supports the boost venturi. Passage 28 is connected to the vertical main fuel well 32 within which is located the usual emulsion tube 34. The latter consists of an outer apertured sleeve like tube within which is spacedly mounted an apertured air bleed tube 36. Tube 36 is open at its upper end to the atmosphere through an orifice, not shown.

The carburetor has the usual fuel or float bowl 38 at the bottom of which is located a main opening 40 controlled by a main fuel jet 42 of predetermined size. The opening connects to an intersecting passage 44 to the bottom of the fuel well 32, in a known manner. Also shown is the usual power valve cavity 46 opening into the float bowl for supplying additional amounts of fuel from the bowl 38 past the main jet 42 to fuel well 32.

More particularly, FIG. 2 shows a unitary power valve assembly in the form of a cartridge 48 that can be easily attached directly to the underside of the float bowl 38 by four bolts 50 (only two shown). The cartridge includes an outer hollow housing 52 that has an upstanding fuel well 54. The well projects through an opening 56 in the bottom of float bowl 38, an outside shoulder 60 on the well wall engaging an internal mating portion on the float bowl, with an O-ring seal 62 between. The well 54 is open at its upper end 64 to the fuel in float bowl 38, and has a window 66 at its lower end adjacent the main portion of housing 52. As best seen in FIG. 1, the window 66 is connected to main flow passage 44.

The fuel well 54 contains an adjustably mounted metering jet 68 threadedly mounted in the well and cooperating with a needle like power valve 70. The power valve at its lower end is threadedly engaged with the core 72 of the rotors 74 of a reversible electric stepper motor 76 that is centrally mounted within housing 52. The stepper motor is of a known construction and in this case effects rotation of the rotor in opposite directions in discrete steps of 15°.

The motor 76 consists of an outer stationary casing 80 enclosing two stacked stators with bifilar wound coils providing a four phase operation, two forward and two reverse, upon selective energization of the phases. Such energization will move the poles 82 of the rotor towards the stator fingers to vertically move the needle valve 70. The rotors are electrically connected to individual terminals 84 and a ground terminal 86, as indicated. The terminals are molded in place in a lower portion of housing 52 to provide a quick male-female disconnect type electrical connection 90, the connectors in this case being one portion of the switch. Suitable polarizing ribs 92 are formed on the top and bottom portions of the harness connection, as well as over centered latch portions 94 for affixing the female connector thereto. In this regard, the female connector would be part of a harness connected to an electronic feedback control unit, not shown, receiving signals from the exhaust system of the engine as well as other portions to then selectively energize the various individual phases of the stepper motor.

The cartridge 48 is also formed with an adjustment screw 96 projecting through the bottom portion of housing 52 to adjust the end stop position of needle valve 70. The needle valve is spring biased as shown to eliminate backlash. A two pronged guide 98 is fixed on the needle valve 70 with the prongs 100 riding vertically in slots 102 provided in the fuel well wall to prevent rotation of the needle valve and thus cause vertical or transitory axial movement of needle valve 70 upon rotation of the stepper motor rotor.

In operation, when a signal is received from the electronic feedback control unit, the stepper motor 76 will be energized to rotate its rotor in one or more discrete steps of 15° each to vertically move the needle valve 70 threadedly engaged with the rotor. This will move the needle valve to a different fuel flow position in the metering jet and thus change the air/fuel ratio of the mixture charge flowing through the carburetor to the desired value called for by the electronic control unit.

While the invention has been shown and described in its preferred embodiment, it will be clear to those skilled in the arts to which it pertains that many changes and modifications may be made thereto without departing from the scope of the invention.

We claim:

1. An electro-mechanical cartridge type fuel flow control valve assembly for attachment to the float bowl of a carburetor for projection of the valve portion thereof into the carburetor float bowl, comprising, in combination, a unitary assembly consisting of an outer housing having an upstanding fuel well open at the top to the fuel in the float bowl and having an opening adjacent its other lower end connected to the carburetor main fuel supply line for the flow of fuel therebetween at all times, a removable fuel metering flow control orifice means integral with the well between the openings, a fuel metering needle type valve mounted in the orifice means for an axial transitory movement relative thereto to selectively control fuel flow volume from the bowl to the main supply line, a reversible electrical stepper motor fixedly received in an integral manner within the housing and having a central core surrounding and threadedly engaging the needle valve for moving the valve axially in discrete steps as a function of electrical impulse input signals to the stepper motor rotating the motor, and electrical connection means to connect the stepper motor to a selectively operable, selective impulse type source of electrical energy.

2. An assembly as in claim 1, including guide means fixed to the valve and mounted in the housing for an axial and non-rotatable movement relative to the housing whereby rotation of the motor effects the axial translation of the needle valve.

3. An assembly as in claim 1, including spring means biasing the needle valve towards a flow reducing position in the metering jet.

* * * * *